United States Patent [19]

Redman

[11] Patent Number: 4,663,955

[45] Date of Patent: May 12, 1987

[54] APPARATUS FOR STRAIGHTENING TUBING

[75] Inventor: Robert J. Redman, Indian River, Mich.

[73] Assignee: Roman Engineering Company, Inc., Afton, Mich.

[21] Appl. No.: 830,071

[22] Filed: Feb. 18, 1986

[51] Int. Cl.[4] ..... B21D 3/02

[52] U.S. Cl. ..... 72/129; 72/160

[58] Field of Search ..... 72/129, 130, 160, 162, 72/164, 203, 132; 140/147

[56] References Cited

U.S. PATENT DOCUMENTS

| | | | |
|---|---|---|---|
| 2,327,103 | 8/1943 | Gude | 72/160 X |
| 3,180,122 | 4/1965 | Evans et al. | 72/160 X |
| 4,216,666 | 8/1980 | Wu | 72/160 X |
| 4,464,919 | 8/1984 | Labbe | 72/162 |

FOREIGN PATENT DOCUMENTS

| | | | |
|---|---|---|---|
| 1577008 | 8/1969 | Fed. Rep. of Germany | 72/160 |

*Primary Examiner*—E. Michael Combs

*Attorney, Agent, or Firm*—Basile, Weintraub & Hanlon

[57] ABSTRACT

Uniform lengths of accurately straight metal tubing are produced from a tubing supply in the form of a multi-layer helically wound coil of tubing by passing tubing from the coil through a first straightening device to approximately straighten the tubing, successively severing uniform lengths of the approximately straightened tubing from tubing discharged from the first straightening device, and throwing the severed length of tubing axially through a guide tube of a length greater than that of the severed length of tubing into the inlet of a second straightening device operable to perform a final precise straightening of the severed length of tubing.

1 Claim, 1 Drawing Figure

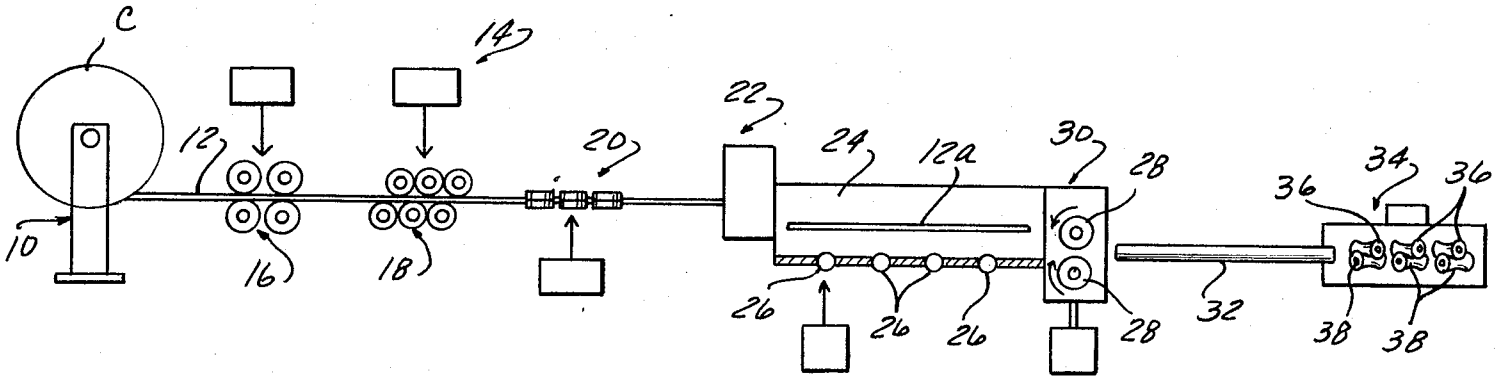
C
10
12
16
14
18
20
22
24
26
26
26
28
28
30
32
34
36
36
38
38

APPARATUS FOR STRAIGHTENING TUBING

BACKGROUND OF THE INVENTION

In the manufacture of metal tubing components for hydraulic or pneumatic circuits on a mass-production basis, as, for example, automotive applications, it is common practice to employ a screw machine to cut uniform lengths in succession from one end of a relatively long piece of tubing stock.

In this operation, a length of tubing stock, typically 12 feet in length, is advanced axially centrally through the rotary chuck of a screw machine until the leading end of the stock projects a predetermined distance forwardly from the chuck. The chuck is then closed to drive the stock in rotation while a forming operation is performed on the projecting length of tubing. The forming operation may consist simply of a cutting-off operation in which a cutting tool is advanced radially to the rotating tube to cut off a predetermined length from the projecting end of the tube, usually chamfering the end as it is so cut. The cut-off part is then ejected, the chuck is opened and the tubing stock is advanced through the chuck to repeat the process.

As stated above, the typical length of tubing stock employed in the foregoing operation is 12 feet and, while the forming or severing operation is being performed on the leading end of the tubing, the entire length of tubing is driven in rotation by the rotary chuck. Because the chucks in question are driven in rotation at speeds of 3,000 to 4,000 RPM, it is essential that the tubing stock handled by the machine be accurately axially straight. Stock suitable for this type of operation is referred to as "rotary straight" tubing stock. If the stock is not "rotary straight", the relatively high speed of rotation will result in unacceptably high vibratory forces. "Rotary straight" tubing stock is normally required to deviate from a straight line by less than 0.002 inches per foot of length.

Because tubing employed in hydraulic and pneumatic circuitry frequently must be bent into various unusual configurations, the tubing material conventionally is a relatively soft metal or alloy which may be easily bent and will hold its bent shape. The property enables the tubing to be wound into multilayer helical coils upon reels for convenient storage and shipment, and most tubing manufacturers arrange their production facilitates so that the tubing is so coiled as produced. While tubing manufacturers will supply tubing in rotary straight lengths, tubing supplied in rotary straight lengths typically commands a price premium of 75% to 100% per unit length over the same tubing supplied in coils.

The coiled tubing will take a so-called "coil set" which can be corrected without undue inconvenience in many applications, particularly those involving low-volume production rates. However, for high-volume production in which parts are processed in automatic screw machines, the problems encountered in straightening coiled tubing to rotary straight tolerances adequate for usage in automatic screw machines have been such that the tubing component manufacturer must choose between the lesser of two evils. Either he must forego the production efficiency of an automatic screw machine or he must pay a premium price to the manufacturer for rotary straight tubing.

For a discussion of the problems encountered in straightening coiled wire, see Labbe U.S. Pat. No. 4,464,919 which also refers to several prior United States patents directed to apparatus for straightening wire. As explained in more detail in U.S. Pat. No. 4,464,919, a primary problem is presented by the fact that the straightening device, which normally consists of a series of rollers, is mounted upon a fixed frame and the supply coil is mounted for rotation upon a fixed stand. The angle at which the wire moves into the straightening device continuously changes as the wire is uncoiled from the reel. This not only results in undue wear of the first group of rollers through which the wire passes, but also results in an uneven or inconsistent straightening of the wire.

The present invention is especially directed to a method and apparatus for producing rotary straight lengths of tubing stock from coiled tubing.

SUMMARY OF THE INVENTION

In accordance with the present invention, tubing from a supply coil is passed through a first group of straightening rollers which approximately straighten the tubing as it passes through the rollers. The approximately straightened tubing is fed from the first group of rollers to a severing device which severs a predetermined length of approximately straightened tubing from the leading end of the tubing.

The severed length of approximately straightened tubing is ejected onto a roller conveyor which axially advances the severed length into the nip of a pair of spaced opposed rollers driven at a relatively high rotary speed which constitute a throwing device. An elongate guide tube immediately downstream from the throwing device guides the thrown tube into the inlet of a second series of self-feeding, accurately ground, hourglass-shaped straightening rolls which perform a final and highly precise straightening of the tube as it passes through these last rolls. The distance between the throwing device and the inlet of this second group of rolls is greater than the length of the severed length of tubing; hence, the second group of rolls receives an approximately straightened length of tubing which is accurately aligned at a constant angle to the optimum path of movement through the second group of straightening rolls.

Other objects and features of the invention will become apparent by reference to the following specification and to the drawings.

IN THE DRAWINGS

FIG. 1 is a schematic side elevational view of a tube straightening apparatus embodying the present invention.

In the drawings, an apparatus embodying the present invention is shown schematically in that the individual elements of the overall apparatus, taken individually, are of conventional and well-known construction.

A supply coil C of tubing to be straightened is supported for free rotation upon a suitable stationary stand designated generally 10 and tubing 12 is led from the coil to pass through a first straightening device designated generally 14 which may include first and second sets 16 and 18 of power-driven rolls mounted for rotation about horizontal axes and a third set 20 of power-driven rolls mounted for rotation about vertical axes at opposite sides of the path of movement of the tubing. The rolls of the various sets are spaced apart from each other by a distance such that the tubing 12 is frictionally gripped between the rolls and the rolls are driven in rotation in directions such that tubing 12 is fed by the rolls from left to right as viewed in FIG. 1. The various sets of rolls 16, 18 and 20 are so aligned with each other as to confine movement of the tubing through the rolls to axial movement along a straight path. This confinement straightens the tubing; however, as the tubing is unwound from coil C, the angle at which tubing 12 enters the first set of rolls 16 continuously changes as the multilayer helical coil is unwound. As explained in greater detail in U.S. Pat. No. 4,464,919 referred to above, this continual shifting or changing of the entrance angle influences the degree to which the tubing is straightened and tubing exiting from the first straightening device 14 will be approximately straightened, but not to a degree such that the tubing which has passed through the first straightening device 14 qualifies as "rotary straight" tubing.

Tubing fed beyond the first straightening device 14 by the powered rollers of the device passes through a severing device 22 which is operable to sever uniform lengths of approximately straightened tubing from the leading end of tubing withdrawn from coil C. A severed length of tubing indicated at 12*a* is ejected from severing device 22 into a V-shaped trough 24 (shown in cross section) having a series of power-driven conveyor rollers 26 located at its bottom which will convey the severed length of tubing 12*a* axially into the nip of a pair of power-driven rollers 28 of a throwing device 30. Rollers 28 are driven at a substantially higher speed of rotation than are conveying rollers 26; and when rollers 28 grip the severed length of tubing 12*a*, the tubing is accelerated axially to the right as viewed in FIG. 1 and thrown through the interior of an elongate guide tube 32 which guides the severed length of tubing into the inlet of a second straightening device 34.

Straightening device 34 includes several opposed pairs of hourglass-shaped, power-driven rolls, the upper and lower rolls 36 and 38 respectively of each pair being mounted for rotation about horizontal axes displaced 90° from each other and respectively displaced 45° from the axis of guide tube 32. The surfaces of rolls 36 and 38 are accurately ground to a predetermined radius and the rolls are vertically spaced from each other so as to frictionally engage the upper and lower surfaces of the severed length of tubing 12*a* as it passes from guide tube 32 into the nip between the first set of rolls 36, 38.

The distance between the throwing rollers 28 and the inlet of straightening device 34 is greater than the length of the severed length of tubing 12*a* so that the trailing end of the severed length of approximately straightened tubing 12*a* has passed to the right clear of the rolls 28 of throwing device 30 at the time the leading end of the tubing length 12*a* arrives at the inlet of second straightening device 34. Thus, at the time the severed length of tubing 12*a* enters the second straightening device 34, the tubing is constrained only by device 34 and the already approximately straightened length of tubing can enter the second straightening device and be fed through the device with no variation on the angle of entry of the tubing into the device. Guide tube 32 is of an internal diameter which is relatively large as compared to the outer diameter of tubing handled by the apparatus, and the guiding function is performed essentially by the trough-like bottom portion of the interior of the tube along which the severed length of tubing 12*a* slides. The remaining portion of the guide tube periphery functions primarily as a safety device surrounding the path of tubing 12*a* as it is thrown clear of throwing device 30. Thus, the guide tube 32 exerts, at most, a minimal constraint on tubing 12*a* as it passes into and through the second straightening device 34.

Because of this minimum constraint, the already approximately straightened severed length of tubing 12*a* can be and is accurately straightened by its passage through the second straightening device 34 to rotary straight tolerance acceptable for usage in automatic screw machines.

While one form of apparatus embodying the invention has been described, it will be apparent to those skilled in the art that the apparatus disclosed may be modified. Therefore, the foregoing description is to be considered exemplary rather than limiting, and the true scope of the invention is that defined in the following claims.

I claim:

1. Apparatus for producing accurately straight uniform lengths of tubing from a supply of tubing wound in a helical coil comprising:

first means for mounting a helically wound coil of tubing for free rotation about the axis of the coil, a first series of tubing straightening roll means operable to draw tubing from a helically wound coil of tubing on said first means through said first roll means and to approximately straighten said tubing as the tubing is advanced through said first roll means, severing means for receiving tubing from said first roll means and cyclically severing a length of approximately straightened tubing from the tubing advanced to said severing means by said first roll means, conveying means for receiving a length of tubing severed by said severing means and axially advancing the length of tubing, throwing means located to receive a length of tubing from said conveying means and to throw the tubing axially from said throwing means, a second series of tubing straightening rolls having an inlet and operable to accurately straighten a severed length of approximately straightened tubing, and guide tube means extending from said throwing means to said inlet of said second roll means for guiding a severed length of tubing thrown by said throwing means into said inlet of said second roll means.

* * * * *